US011121443B2

(12) United States Patent
Uemichi

(10) Patent No.: US 11,121,443 B2
(45) Date of Patent: Sep. 14, 2021

(54) BANDPASS FILTER

(71) Applicant: FUJIKURA LTD., Tokyo (JP)

(72) Inventor: Yusuke Uemichi, Sakura (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 16/982,665

(22) PCT Filed: Mar. 27, 2019

(86) PCT No.: PCT/JP2019/013353
§ 371 (c)(1),
(2) Date: Sep. 21, 2020

(87) PCT Pub. No.: WO2019/189456
PCT Pub. Date: Oct. 3, 2019

(65) Prior Publication Data

US 2021/0066773 A1 Mar. 4, 2021

(30) Foreign Application Priority Data

Mar. 28, 2018 (JP) ..... JP2018-063124

(51) Int. Cl.
*H01P 1/208* (2006.01)
*H01P 1/213* (2006.01)
*H01P 1/20* (2006.01)

(52) U.S. Cl.
CPC ..... *H01P 1/208* (2013.01); *H01P 1/2002* (2013.01); *H01P 1/2088* (2013.01); *H01P 1/2138* (2013.01)

(58) Field of Classification Search
CPC ..... H01P 1/2138; H01P 1/208; H01P 1/2088; H01P 1/2002
USPC ..... 333/208, 209, 212
See application file for complete search history.

(56) References Cited

U.S. PATENT DOCUMENTS

2004/0041663 A1* 3/2004 Uchimura ..... H01P 1/2088 333/135

FOREIGN PATENT DOCUMENTS

| | | | |
|---|---|---|---|
| CN | 204130666 | U | 1/2015 |
| JP | H11-136009 | A | 5/1999 |
| JP | 2003-504924 | A | 2/2003 |
| WO | 2009/133713 | A1 | 11/2009 |

OTHER PUBLICATIONS

Notification of Transmittal of Translation of the International Preliminary Report on Patentability (Form PCT/IB/338) issued in counterpart International Application No. PCT/JP2019/013353 dated Oct. 8, 2020 with Forms PCT/IB/373 and PCT/ISA/237. (8 pages).
International Search report dated Apr. 23, 2019, issued in counterpart Application No. PCT/JP2019/013353, with English Translation. (2 pages).

(Continued)

*Primary Examiner* — Rakesh B Patel
(74) *Attorney, Agent, or Firm* — Westerman, Hattori, Daniels & Adrian, LLP

(57) ABSTRACT

Realized is a post-wall waveguide bandpass filter in which a bypass phenomenon is less likely to occur. In a post-wall waveguide bandpass filter (1) including an input part (10*a*) and an output part (10*b*), each of a first distance (distance X11), a second distance (not illustrated in FIG. 2), a third distance (distance X21), and a fourth distance (not illustrated in FIG. 2) is not more than 1.5 times a post interval (d).

4 Claims, 7 Drawing Sheets

(56) References Cited

OTHER PUBLICATIONS

Kazuaki Yoshida, "Technology and Applications of Microwave Filters", Japan Radio Technical Report, JRC Nihon Musen, No. 64, pp. 2013-12 to 16, with English Translation; Cited in the Specification. (15 pages).
Y. Umeichi et al., "Compact and low-loss bandpass filter realized in silica-based post-wall waveguide for 60-GHz application", IEEE MTT-S IMS, May 2015; Cited in the Specification. (3 pages).
Notification of Transmittal of Translation of the International Preliminary Report on Patentability (Form PCT/IB/338) issued in International Application No. PCT/JP2019/009368 dated Oct. 8, 2020 with Forms PCT/IB/373 and PCT/ISA/237. (counterpart to U.S. Appl. No. 17/040,767) (12 pages).
International Search report dated Apr. 9, 2019, issued in Application No. PCT/JP2019/009368, with English Translation, (counterpart to U.S. Appl. No. 17/040,767) (2 pages).
Related co-pending U.S. Appl. No. 17/040,767).

* cited by examiner

BANDPASS FILTER

TECHNICAL FIELD

The present invention relates to a bandpass filter of a post-wall waveguide type (hereinafter, referred to as a post-wall waveguide bandpass filter).

BACKGROUND ART

Bandpass filters are widely used which cut off electromagnetic waves that fall outside passbands while allowing electromagnetic waves that fall within the passbands to pass therethrough. Bandpass filters which operate in millimeter wave bands are typically implemented as waveguide tubes or waveguides which contain a plurality of resonators coupled in series.

Non Patent Literature 1 discloses a bandpass filter of a metallic waveguide tube type (hereinafter, referred to as a metallic waveguide tube bandpass filter). Non Patent Literature 2 discloses a post-wall waveguide bandpass filter. The post-wall waveguide bandpass filter is more advantageous than the metallic waveguide tube bandpass filter in the following points. That is, the post-wall waveguide bandpass filter is less expensive, smaller in size, and lighter in weight than the metallic waveguide tube bandpass filter.

CITATION LIST

Non-Patent Literature

[Non-patent Literature 1]
Kazuaki YOSHIDA, "Technology and Applications of Microwave Filters," JRC Review, No. 64, December 2013
[Non-patent Literature 2]
Y. Uemichi, O. Nukage, K. Nakamura, X. Han, R. Hosono, and S. Amakawa, "Compact and low-loss bandpass filter realized in silica-based post-wall waveguide for 60-GHz application", IEEE MTT-S IMS, May 2015

SUMMARY OF INVENTION

Technical Problem

However, the inventors of the present application have discovered that, in a post-wall waveguide bandpass filter, a bypass phenomenon in which an electromagnetic wave that falls outside a passband passes through the bandpass filter can occur by an edge region (later described) functioning as a bypass waveguide. In a case where such a bypass phenomenon occurs, isolation performance of the bandpass filter deteriorates.

The bypass phenomenon that can occur in the post-wall waveguide bandpass filter will be described below more specifically, with reference to FIGS. 6 and 7. In the following description, in a coordinate system illustrated in each of FIGS. 6 and 7, a positive direction of an x axis (hereinafter, referred to as an x-axis positive direction) will be referred to as "right", a negative direction of the x axis (hereinafter, referred to as an x-axis negative direction) will be referred to as "left", a positive direction of a y axis (hereinafter, referred to as a y-axis positive direction) will be referred to as "front", a negative direction of the y axis (hereinafter, referred to as a y-axis negative direction) will be referred to as "back", a positive direction of a z axis (hereinafter, referred to as a z-axis positive direction) will be referred to as "up", and a negative direction of the z axis (hereinafter, referred to as a z-axis negative direction) will be referred to as "down".

FIG. 6 is an exploded perspective view of a bandpass filter 9. As illustrated in FIG. 6, the bandpass filter 9 includes: a dielectric substrate 91; an upper wide wall 92*a* provided on an upper surface of the dielectric substrate 91; a lower wide wall 92*b* provided on a lower surface of the dielectric substrate 91; and a post wall 93 provided inside the dielectric substrate 91. The post wall 93 is constituted by a set of conductor posts P1, P2, . . . arranged in the form of a fence.

FIG. 7 is a plan view of the bandpass filter 9. As illustrated in FIG. 7, the post wall 93 includes six partition wall pairs 931 through 936 in addition to a right narrow wall 930*a*, a left narrow wall 930*b*, a front narrow wall 930*c*, and a back narrow wall 930*d*. A region D1 having a shape of a rectangular parallelepiped, which region D1 is sandwiched between the wide walls 92*a* and 92*b* (not illustrated) on upper and lower sides, respectively, of the region D1 and is surrounded by the narrow walls 930*a* through 930*d* on right, left, front, and back sides, respectively, of the region D1, functions as a rectangular waveguide in which an electromagnetic wave is guided. Hereinafter, the region D1 will be referred to as a "waveguide region".

The waveguide region D1 is partitioned into seven small regions D11 through D17 by the six partition wall pairs 931 through 936. In the small region D11, an input part 90*a*, via which electromagnetic waves are inputted from a first microstrip line 5 into the waveguide region D1, is provided. Hereinafter, the small region D11 will be referred to as an "input region". Each of five small regions D12 through D16 functions as a resonator. Hereinafter, each of the small regions D12 through D16 will be referred to as a "resonance region". In the small region D17, an output part 90*b*, via which an electromagnetic wave is outputted from the waveguide region D1 to a second microstrip line 6, is provided. Hereinafter, the small region D17 will be referred to as an "output region".

According to the bandpass filter 9, the five resonance regions D12 through D16 coupled in series function as a bandpass filter of a Chebyshev type, which bandpass filter selectively allows an electromagnetic wave that falls within a specific passband to pass therethrough. Therefore, of electromagnetic waves which have been inputted from the first microstrip line 5 into the input region D11 via the input part 90*a*, merely an electromagnetic wave which falls within a specific passband is outputted from the output region D17 to the second microstrip line 6 via the output part 90*b*.

However, a bypass phenomenon can occur in such a bandpass filter 9. That is, a phenomenon can occur in which part of an electromagnetic wave that should be guided from the first microstrip line 5 to the second microstrip line 6 through the waveguide region D1 is guided from the first microstrip line 5 to the second microstrip line 6 through an edge region D2 that exists outside the waveguide region D1. Here, the edge region D2 refers to, in the dielectric substrate 91, a region and a vicinity thereof, which region is sandwiched between an outer edge of the upper wide wall 92*a* and an outer edge of the lower wide wall 92*b* (see FIG. 7).

The present invention has been made in view of the above problem, and an object thereof is to realize a post-wall waveguide bandpass filter in which a bypass phenomenon is less likely to occur.

Solution to Problem

In order to attain the above object, a bandpass filter in accordance with an aspect of the present invention is a bandpass filter including: a dielectric substrate; a first wide wall which is provided on a first main surface of the dielectric substrate; a second wide wall which is provided on a second main surface of the dielectric substrate; a post wall which is provided inside the dielectric substrate and which is constituted by a first short wall, a second short wall, a first side wall, and a second side wall; an input part which is provided near the first short wall and via which an electromagnetic wave is inputted into a waveguide region, the waveguide region being formed inside the dielectric substrate by the first wide wall, the second wide wall, and the post wall and including a plurality of resonance regions; and an output part which is provided near the second short wall and via which the electromagnetic wave is outputted from the waveguide region, at least any one of first through fourth distances being not more than 1.5 times a post interval at least in a partial section of the waveguide region, the first distance being a distance from a wall center of the first side wall to part of an edge of the first wide wall which part extends along the first side wall, the second distance being a distance from the wall center of the first side wall to part of an edge of the second wide wall which part extends along the first side wall, the third distance being a distance from a wall center of the second side wall to part of the edge of the first wide wall which part extends along the second side wall, the fourth distance being a distance from the wall center of the second side wall to part of the edge of the second wide wall which part extends along the second side wall, the post interval being a distance between respective centers of adjacent ones of a plurality of conductor posts which constitute the first side wall and the second side wall.

Advantageous Effects of Invention

According to an aspect of the present invention, realized is a post-wall waveguide bandpass filter in which a bypass phenomenon is less likely to occur.

DESCRIPTION OF EMBODIMENTS

Embodiment (Configuration of Bandpass Filter)

Figure 1:
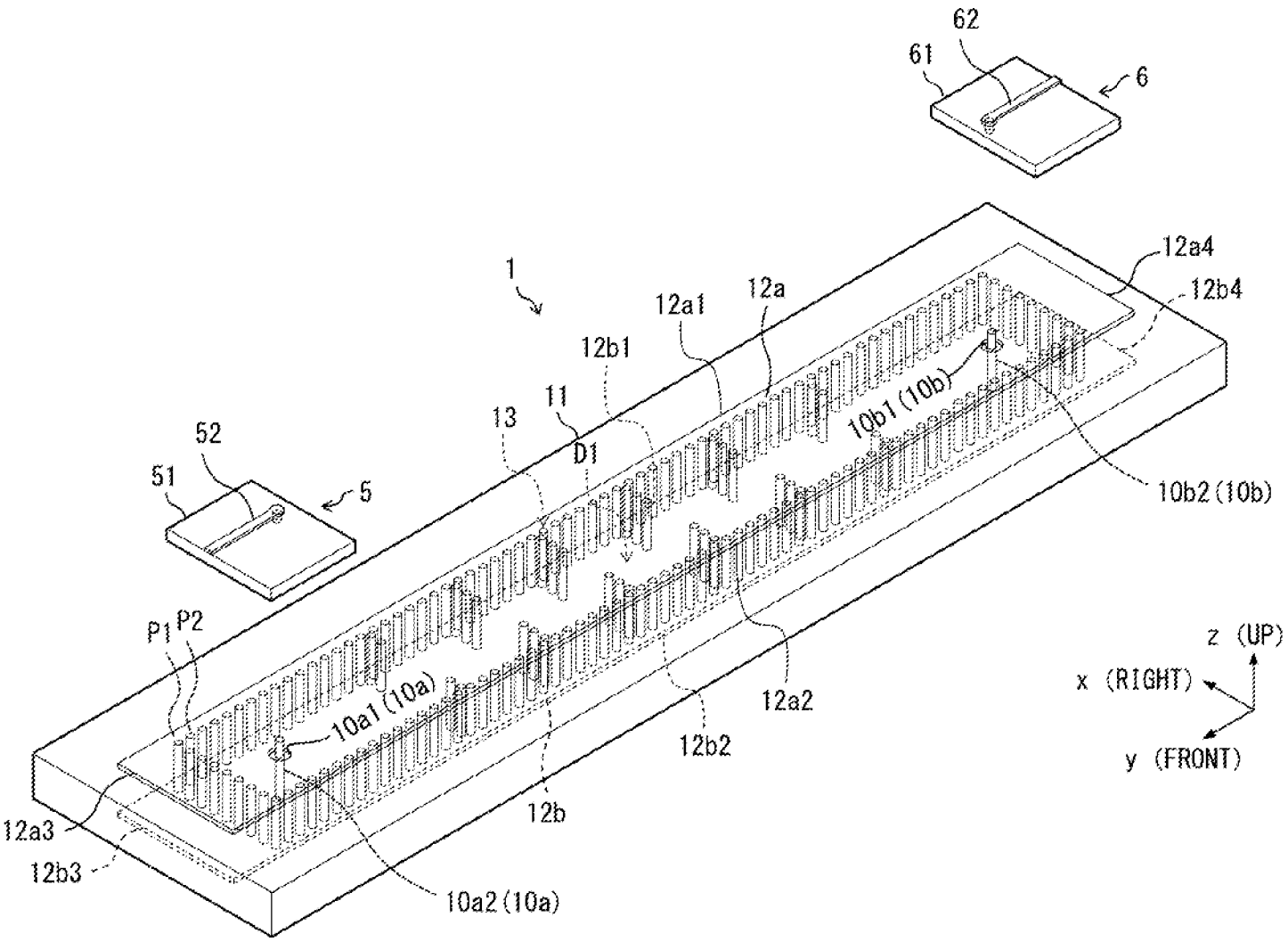
FIG. 1 is an exploded perspective view of a bandpass filter in accordance with an embodiment of the present invention.
Figure 2:
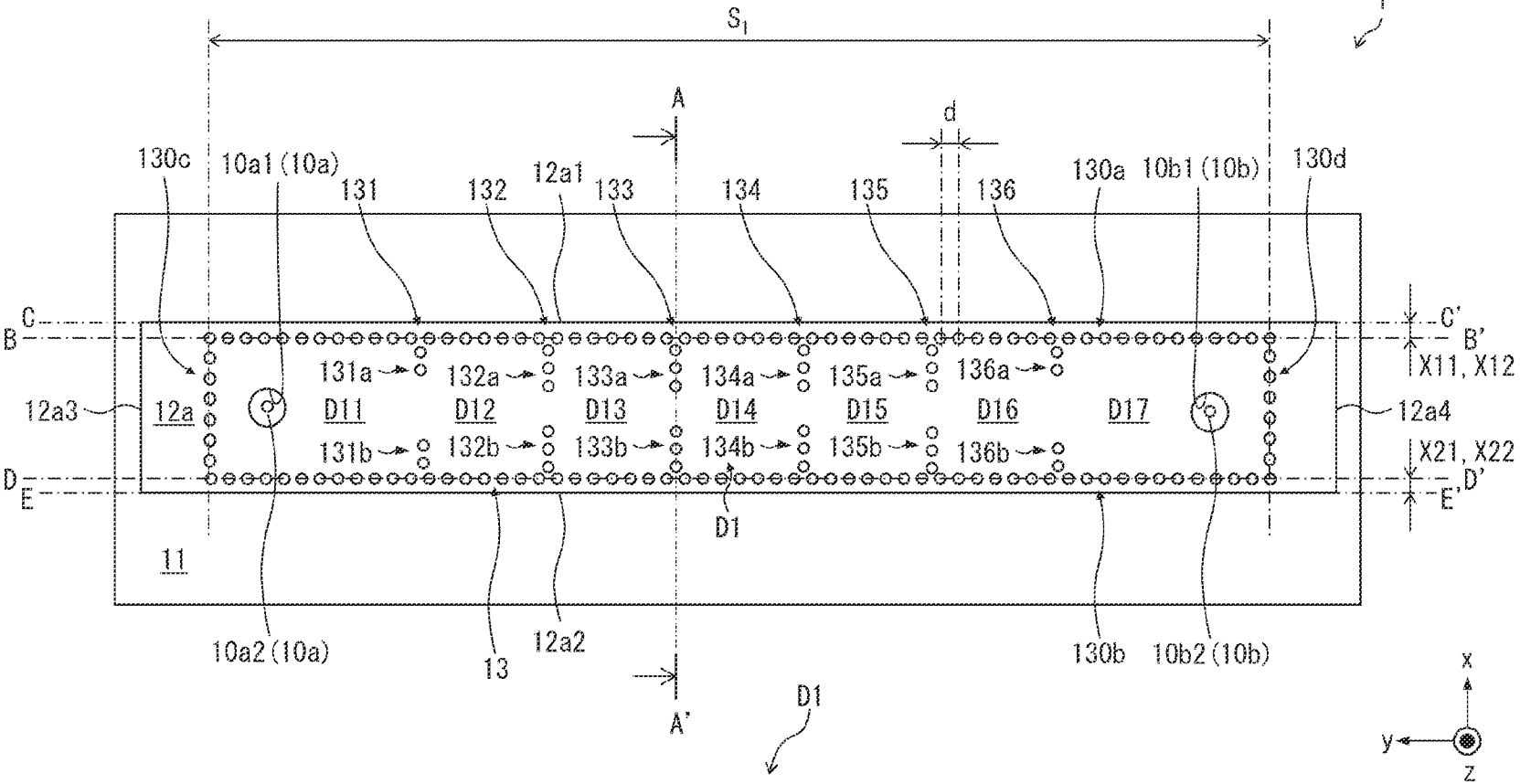
FIG. 2 is a plan view of the bandpass filter illustrated in FIG. 1.
Figure 3:
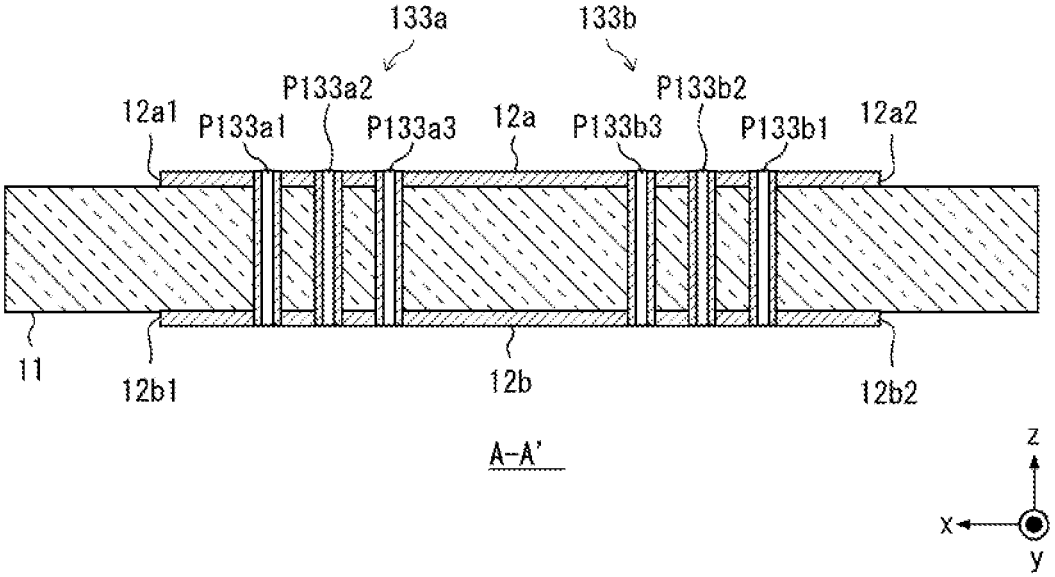
FIG. 3 is a cross-sectional view of the bandpass filter illustrated in FIG. 1.

The following description will discuss a configuration of a bandpass filter 1 in accordance with an embodiment of the present invention with reference to FIGS. 1 through 3. FIG. 1 is an exploded perspective view of the bandpass filter 1. FIG. 2 is a plan view of the bandpass filter 1. FIG. 3 is a cross-sectional view of the bandpass filter 1. Note that FIG. 1 also illustrates a first microstrip line 5 and a second microstrip line 6 to be connected to the bandpass filter 1. Note also that a cross section illustrated in FIG. 3 is a cross section of the bandpass filter 1 taken along an A-A' line illustrated in FIG. 2.

As illustrated in FIG. 1, the bandpass filter 1 includes: a dielectric substrate 11; an upper wide wall 12*a* provided on an upper surface of the dielectric substrate 11; a lower wide wall 12*b* provided on a lower surface of the dielectric substrate 11; and a post wall 13 provided inside the dielectric substrate 11. The upper surface of the dielectric substrate 11 is an aspect of a first main surface recited in the claims, and the lower surface of the dielectric substrate 11 is an aspect of a second main surface recited in the claims.

The dielectric substrate 11 is a plate-shaped member constituted by a dielectric. In the present embodiment, a quartz substrate is used as the dielectric substrate 11. Note, however, that a material of the dielectric substrate 11 is not limited to quartz and only needs to be a dielectric. For example, the material of the dielectric substrate 11 may be a resin (for example, a Teflon (registered trademark)-based resin or a liquid crystal polymer resin).

Note that, in the following description, out of six surfaces which constitute a surface of the dielectric substrate 11, each of two surfaces each of which has the largest area will be referred to as a "main surface". In particular, in a case where it is necessary to distinguish between these two main surfaces, a first one of the two main surfaces, that is, the first main surface will be referred to as an "upper surface", and a second one of the two main surfaces, that is, the second main surface, which faces the first main surface, will be referred to as a "lower surface". Out of the six surfaces which constitute the surface of the dielectric substrate 11, each of four surfaces other than the two main surfaces will be referred to as a "side surface". In particular, in a case where it is necessary to distinguish between these four side surfaces, a first one of the four side surfaces will be referred to as a "right side surface", a second one of the four side surfaces which second one faces the first one of the four side surfaces will be referred to as a "left side surface", a third one of the four side surfaces which third one is perpendicular to the first one and the second one of the four side surfaces will be referred to as a "front side surface", and a fourth one of the four side surfaces which fourth one faces the third one of the four side surfaces will be referred to as a "back side surface". Note, however, that these designations are for convenience of description and do not impose any restriction on arrangement of the bandpass filter 1. Furthermore, in the following description, a rectangular coordinate system will be employed in which a direction from the left side surface of the dielectric substrate 11 toward the right side surface of the dielectric substrate 11 is an x-axis positive direction, a direction from the back side surface of the dielectric substrate 11 toward the front side surface of the dielectric substrate 11 is a y-axis positive direction, and a direction from the lower surface of the dielectric substrate 11 to the upper surface of the dielectric substrate 11 is a z-axis positive direction.

The upper wide wall 12*a* is a rectangular film-shaped conductor provided on the upper surface of the dielectric substrate 11. The lower wide wall 12*b* is a rectangular film-shaped conductor provided on the lower surface of the dielectric substrate 11 so as to face the upper wide wall 12*a*. As illustrated in FIG. 1, out of four sides which constitute an outer edge of the upper wide wall 12*a*, a long side located on a right side (in the x-axis positive direction) will be referred to as a long side 12*a*1, a long side located on a left side (in the x-axis negative direction) will be referred to as a long side 12a2, a short side located on a front side (in the y-axis positive direction) will be referred to as a short side 12a3, and a short side located on a back side (in the y-axis negative direction) will be referred to as a short side 12a4. Similarly, out of four sides which constitute an outer edge of the lower wide wall 12b, a long side located on a right side (in the x-axis positive direction) will be referred to as a long side 12b1, a long side located on a left side (in the x-axis negative direction) will be referred to as a long side 12b2, a short side located on a front side (in the y-axis positive direction) will be referred to as a short side 12b3, and a short side located on a back side (in the y-axis negative direction) will be referred to as a short side 12b4. The upper wide wall 12a is an aspect of a first wide wall recited in the claims, and the lower wide wall 12b is an aspect of a second wide wall recited in the claims. The outer edge of the upper wide wall 12a is an aspect of an edge of the first wide wall recited in the claims, and the outer edge of the lower wide wall 12b is an aspect of an edge of the second wide wall recited in the claims.

In the present embodiment, a copper film is used as each of the upper wide wall 12a and the lower wide wall 12b. Note, however, that a material of each of the upper wide wall 12a and the lower wide wall 12b is not limited to copper, and only needs to be a conductor. For example, the material of each of the upper wide wall 12a and the lower wide wall 12b may be metal, other than copper, such as aluminum or gold. Further, each of the upper wide wall 12a and the lower wide wall 12b may be a plate-shaped conductor having a sufficient thickness.

A configuration of the post wall 13 will be described below with reference to FIGS. 1 through 3. The post wall 13 is constituted by a set of a plurality of conductor posts P1, P2, . . . provided inside the dielectric substrate 11. Each conductor post Pi (i=1, 2, . . . ) is a film-shaped (cylindrical) conductor which covers an inner wall of a through-hole that passes through the dielectric substrate 11 up and down, as illustrated in FIG. 3 (FIG. 3 illustrates, as an example, conductor posts 133a1 through P133a3 and P133b1 through P133b3 each of which is an aspect of the each conductor post Pi). An upper end and a lower end of the each conductor post Pi are in contact with the upper wide wall 12a and the lower wide wall 12b, respectively, and the each conductor post Pi short-circuits the upper wide wall 12a and the lower wide wall 12b. In the present embodiment, copper is used as a material of the each conductor post Pi. Note, however, that the material of the each conductor post Pi is not limited to copper, and only needs to be a conductor. For example, the material of the each conductor post Pi may be metal, other than copper, such as aluminum or gold. Further, the each conductor post Pi may be a massive (cylindrical) conductor with which the through-hole that passes through the dielectric substrate 11 up and down is filled. These conductor posts P1, P2, . . . are arranged in the form of a fence, and the post wall 13, which is constituted by the conductor posts P1, P2, . . . , functions as a conductor wall which reflects an electromagnetic wave having a wavelength sufficiently longer than a post interval.

As illustrated in FIG. 2, the post wall 13 includes six partition wall pairs, that is, first through sixth partition wall pairs 131 through 136 in addition to a right narrow wall 130a, a left narrow wall 130b, a front narrow wall 130c, and a back narrow wall 130d. Note that each of the front narrow wall 130c and the back narrow wall 130d is sometimes referred to as a short wall. The front narrow wall 130c is an aspect of a first short wall recited in the claims, and the back narrow wall 130d is an aspect of a second short wall recited in the claims.

Each of the right narrow wall 130a and the left narrow wall 130b is constituted by a subset of the conductor posts P1, P2, . . . , that is, constituted by two or more of the conductor posts P1, P2, . . . which two or more are arranged in the form of a fence along the y axis. The right narrow wall 130a is located on a right side (in the x-axis positive direction) of a center of the dielectric substrate 11 so as to be parallel to a yz plane. On the other hand, the left narrow wall 130b is located on a left side (in the x-axis negative direction) of the center of the dielectric substrate 11 so as to be parallel to the yz plane. The right narrow wall 130a is an aspect of a first side wall recited in the claims, and the left narrow wall 130b is an aspect of a second side wall recited in the claims.

Each of the front narrow wall 130c and the back narrow wall 130d is constituted by a subset of the conductor posts P1, P2, . . . , that is, constituted by two or more of the conductor posts P1, P2, . . . which two or more are arranged in the form of a fence along the x axis. The front narrow wall 130c is located on a front side (in the y-axis positive direction) of the center of the dielectric substrate 11 so as to be parallel to a zx plane. On the other hand, the back narrow wall 130d is located on a back side (in the y-axis negative direction) of the center of the dielectric substrate 11 so as to be parallel to the zx plane.

A region D1 having a shape of a rectangular parallelepiped, which region D1 is sandwiched between the wide walls 12a and 12b on upper and lower sides, respectively, of the region D1 and is surrounded by the narrow walls 130a through 130d on right, left, front, and back sides, respectively, of the region D1, functions as a rectangular waveguide in which an electromagnetic wave inputted via an input part 10a (later described) is guided. Hereinafter, the region D1 will be referred to as a "waveguide region".

The first partition wall pair 131 is constituted by a first right partition wall 131a and a first left partition wall 131b. Each of the first right partition wall 131a and the first left partition wall 131b is constituted by a subset of the conductor posts P1, P2, . . . , that is, constituted by two or more of the conductor posts P1, P2, . . . (in the present embodiment, two conductor posts) which two or more are arranged in the form of a fence along the x axis. The first right partition wall 131a is located on a back side of the front narrow wall 130c and is located on the right side (in the x-axis positive direction) of the center of the dielectric substrate 11 so as to be parallel to the zx plane. The first left partition wall 131b is located on the back side of the front narrow wall 130c and is located on the left side (in the x-axis negative direction) of the center of the dielectric substrate 11 so as to be parallel to the zx plane. A distance from the front narrow wall 130c to the first right partition wall 131a and a distance from the front narrow wall 130c to the first left partition wall 131b are identical to each other. Further, a left end of the first right partition wall 131a (an end located in the x-axis negative direction) and a right end of the first left partition wall 131b (an end located in the x-axis positive direction) are spaced apart from each other.

The second partition wall pair 132 is constituted by a second right partition wall 132a and a second left partition wall 132b. Each of the second right partition wall 132a and the second left partition wall 132b is constituted by a subset of the conductor posts P1, P2, . . . , that is, constituted by two or more of the conductor posts P1, P2, . . . (in the present embodiment, three conductor posts) which two or more are arranged in the form of a fence along the x axis. The second right partition wall 132*a* is located on a back side of the first right partition wall 131*a* and is located on the right side (in the x-axis positive direction) of the center of the dielectric substrate 11 so as to be parallel to the zx plane. The second left partition wall 132*b* is located on a back side of the first left partition wall 131*b* and is located on the left side (in the x-axis negative direction) of the center of the dielectric substrate 11 so as to be parallel to the zx plane. A distance from the front narrow wall 130*c* to the second right partition wall 132*a* and a distance from the front narrow wall 130*c* to the second left partition wall 132*b* are identical to each other. Further, a left end of the second right partition wall 132*a* (an end located in the x-axis negative direction) and a right end of the second left partition wall 132*b* (an end located in the x-axis positive direction) are spaced apart from each other.

The third partition wall pair 133, which is located on a back side of the second partition wall pair 132, is configured similarly to the second partition wall pair 132. The fourth partition wall pair 134, which is located on a back side of the third partition wall pair 133, is configured similarly to the second partition wall pair 132. The fifth partition wall pair 135, which is located on a back side of the fourth partition wall pair 134, is configured similarly to the second partition wall pair 132. The sixth partition wall pair 136, which is located on a back side of the fifth partition wall pair 135, is configured similarly to the first partition wall pair 131. These six partition wall pairs, that is, the first through sixth partition wall pairs 131 through 136 are arranged at regular intervals along the y axis.

The waveguide region D1 as has been described is partitioned into seven small regions D11 through D17 by the six partition wall pairs, that is, the first through sixth partition wall pairs 131 through 136.

In the small region D11, which is sandwiched between the front narrow wall 130*c* and the first partition wall pair 131 on front and back sides, respectively, of the small region D11, of the waveguide region D1, the input part 10*a* is provided. The input part 10*a* is constituted by an opening 10*al*, which is provided in the upper wide wall 12*a*, and a blind via 10*a*2, which is inserted in the dielectric substrate 11 through the opening 10*al*. The blind via 10*a*2 is electrically insulated from both the upper wide wall 12*a* and the lower wide wall 12*b*. The blind via 10*a*2 is caused to pass through a dielectric layer 51 of the first microstrip line 5 and is connected to a signal line 52 of the first microstrip line 5, as illustrated in FIG. 1. In this case, electromagnetic waves which have been guided in the first microstrip line 5 are input into the small region D11 via the input part 10*a*. Hereinafter, the small region D11 will be referred to as an "input region". The blind via 10*a*2 is configured similarly to the each conductor post Pi, except that the blind via 10*a*2 is not caused to pass through the dielectric substrate 11 and one end of the blind via 10*a*2 (an end located in the z-axis negative direction) is located inside the dielectric substrate 11.

In the waveguide region D1, the small region D12, which is sandwiched between the first partition wall pair 131 and the second partition wall pair 132 on front and back sides, respectively, of the small region D12, functions as a first resonator. Hereinafter, the small region D12 will be referred to as a "first resonance region". The first resonance region D12 is coupled to the above-described input region D1*l* with a gap between the first right partition wall 131*a* and the first left partition wall 131*b* serving as a coupling window.

In the waveguide region D1, the small region D13, which is sandwiched between the second partition wall pair 132 and the third partition wall pair 133 on front and back sides, respectively, of the small region D13, functions as a second resonator. Hereinafter, the small region D13 will be referred to as a "second resonance region". The second resonance region D13 is coupled to the above-described first resonance region D12 with a gap between the second right partition wall 132*a* and the second left partition wall 132*b* serving as a coupling window.

In the waveguide region D1, the small region D14, which is sandwiched between the third partition wall pair 133 and the fourth partition wall pair 134 on front and back sides, respectively, of the small region D14, functions as a third resonator. Hereinafter, the small region D14 will be referred to as a "third resonance region". The third resonance region D14 is coupled to the above-described second resonance region D13 with a gap between a third right partition wall 133*a* and a third left partition wall 133*b* serving as a coupling window.

In the waveguide region D1, the small region D15, which is sandwiched between the fourth partition wall pair 134 and the fifth partition wall pair 135 on front and back sides, respectively, of the small region D15, functions as a fourth resonator. Hereinafter, the small region D15 will be referred to as a "fourth resonance region". The fourth resonance region D15 is coupled to the above-described third resonance region D14 with a gap between a fourth right partition wall 134*a* and a fourth left partition wall 134*b* serving as a coupling window.

In the waveguide region D1, the small region D16, which is sandwiched between the fifth partition wall pair 135 and the sixth partition wall pair 136 on front and back sides, respectively, of the small region D16, functions as a fifth resonator. Hereinafter, the small region D16 will be referred to as a "fifth resonance region". The fifth resonance region D16 is coupled to the above-described fourth resonance region D15 with a gap between a fifth right partition wall 135*a* and a fifth left partition wall 135*b* serving as a coupling window.

In the small region D17, which is sandwiched between the sixth partition wall pair 136 and the back narrow wall 130*d* on front and back sides, respectively, of the small region D17, of the waveguide region D1, an output part 10*b* is provided. The output part 10*b* is constituted by an opening 10*b*1, which is provided in the upper wide wall 12*a*, and a blind via 10*b*2, which is inserted in the dielectric substrate 11 through the opening 10*b*1. The blind via 10*b*2 is electrically insulated from both the upper wide wall 12*a* and the lower wide wall 12*b*. The blind via 10*b*2 is caused to pass through a dielectric layer 61 of the second microstrip line 6 and is connected to a signal line 62 of the second microstrip line 6, as illustrated in FIG. 1. In this case, an electromagnetic wave which has been guided in the small region D17 is outputted to the second microstrip line 6 via the output part 10*b*. Hereinafter, the small region D17 will be referred to as an "output region". The output region D17 is coupled to the above-described fifth resonance region D16 with a gap between a sixth right partition wall 136*a* and a sixth left partition wall 136*b* serving as a coupling window. The blind via 10*b*2 is configured identically to the blind via 10*a*2.

According to the bandpass filter 1, the five resonance regions D12 through D16 coupled in series function as a bandpass filter of a Chebyshev type, which bandpass filter selectively allows an electromagnetic wave that falls within a specific passband to pass therethrough. Therefore, of electromagnetic waves which have been inputted from the first microstrip line 5 into the input region D11 via the input part 10*a*, merely an electromagnetic wave which falls within a specific passband is outputted from the output region D17 to the second microstrip line 6 via the output part 10*b*.

In the present embodiment, a bandpass filter including the five resonance regions D12 through D16 is realized by partitioning the waveguide region D1 with use of the six partition wall pairs, that is, the first through sixth partition wall pairs 131 through 136, but the present invention is not limited to such a configuration. Namely, by partitioning the waveguide region D1 with use of n (n is any natural number of 3 or more) partition wall pairs, it is possible to realize a bandpass filter including n−1 resonance regions. For example, (1) a bandpass filter including two resonance regions may be realized by partitioning the waveguide region D1 with use of three partition wall pairs, (2) a bandpass filter including three resonance regions may be realized by partitioning the waveguide region D1 with use of four partition wall pairs, or (3) a bandpass filter including four resonance regions may be realized by partitioning the waveguide region D1 with use of five partition wall pairs.

Further, in the present embodiment, the input part 10*a* is realized by the opening 10*a*1 and the blind via 10*a*2 so that electromagnetic waves which have been guided in the first microstrip line 5 are inputted into the bandpass filter 1, but the present invention is not limited to such a configuration. That is, the input part 10*a* may be realized merely by the opening 10*a*1 so that electromagnetic waves which have been guided in a waveguide tube are inputted into the bandpass filter 1. In this case, a shape and a size of the opening 10*a*1 are determined according to a shape and a size of an output opening of the waveguide tube. Note that, in a case where electromagnetic waves which have been guided in a coplanar line are inputted into the bandpass filter 1, the input part 10*a* may be constituted by the opening 10*a*1 and the blind via 10*a*2, as in the present embodiment.

Similarly, in the present embodiment, the output part 10*b* is realized by the opening 10*b*1 and the blind via 10*b*2 so that an electromagnetic wave which has passed through the bandpass filter 1 is outputted to the second microstrip line 6, but the present invention is not limited such a configuration. That is, the output part 10*b* may be realized merely by the opening 10*b*1 so that an electromagnetic wave which has passed through the bandpass filter 1 is outputted to a waveguide tube. In this case, a shape and a size of the opening 10*b*1 are determined according to a shape and a size of an input opening of the waveguide tube. Note that, in a case where an electromagnetic wave which has passed through the bandpass filter 1 is inputted into a coplanar line, the output part 10*b* may be constituted by the opening 10*b*1 and the blind via 10*b*2, as in the present embodiment.

The bandpass filter 1 has a reflection-symmetric structure with respect to, as a symmetry plane, a plane which passes through a center of the third resonance region D14 and which is parallel to the zx plane. Therefore, (1) the input region D11 which includes the input part 10*a* and the output region D17 which includes the output part 10*b* have an identical structure, (2) the resonance region D12 and the resonance region D16 have an identical structure, (3) the resonance region D13 and the resonance region D15 have an identical structure, and the resonance region D14 has a reflection-symmetric structure with respect to the symmetry plane.

Thus, a structure of the bandpass filter 1 as viewed from the input part 10*a* and a structure of the bandpass filter 1 as viewed from the output part 10*b* are equivalent to each other. Therefore, according to the bandpass filter 1, an identical function is achieved in either of a case where the input part 10*a* is employed as an input port via which an electromagnetic wave is inputted and a case where the output part 10*b* is employed as an input port via which an electromagnetic wave is inputted.

(Features of Bandpass Filter)

In the bandpass filter 1, it is noteworthy that, in a section $S_1$ which is an entire section of the waveguide region D1, each of distances X11 and X21 is not more than 1.5 times a post interval d. The bandpass filter 1 illustrated in FIG. 2 is configured such that each of the distances X11 and X21 is not more than the post interval d. In this manner, it is more preferable that each of the distances X11 and X21 be not more than the post interval d.

The distance X11 is an aspect of a first distance recited in the claims, and the distance X21 is an aspect of a third distance recited in the claims. The distance X11 is a distance from a wall center of the right narrow wall 130*a* (B-B' line illustrated in FIG. 2) to part of the outer edge of the upper wide wall 12*a* which part extends along the right narrow wall 130*a*, that is, the long side 12*a*1 (C-C' line illustrated in FIG. 2). The distance X21 is a distance from a wall center of the left narrow wall 130*b* (D-D' line illustrated in FIG. 2) to part of the outer edge of the upper wide wall 12*a* which part extends along the left narrow wall 130*b*, that is, the long side 12*a*2 (E-E' line illustrated in FIG. 2).

In the present embodiment, the upper wide wall 12*a* and the lower wide wall 12*b* are congruous with each other, and are located so that their outer edges coincide with each other in a plan view (see FIG. 1). Therefore, although the lower wide wall 12*b* is not illustrated in FIG. 2, a position of the long side 12*b*1 coincides with a position of the long side 12*a*1 (i.e., a position of the C-C' line), and a position of the long side 12*b*2 coincides with a position of the long side 12*a*2 (a position of the E-E' line). Thus, a distance X12 from the wall center of the right narrow wall 130*a* to part of the outer edge of the lower wide wall 12*b* which part extends along the right narrow wall 130*a*, that is, the long side 12*b*1 is equal to the distance X11. Further, a distance X22 from the wall center of the left narrow wall 130*b* to part of the outer edge of the lower wide wall 12*b* which part extends along the left narrow wall 130*b*, that is, the long side 12*b*2 is equal to the distance X21. The distance X12 is an aspect of a second distance recited in the claims, and the distance X22 is an aspect of a fourth distance recited in the claims.

The post interval d is a distance between respective centers of adjacent ones of the plurality of conductor posts which constitute the right narrow wall 130*a* and the left narrow wall 130*b*. In the present embodiment, d=200 μm is employed as the post interval d which is common to the right narrow wall 130*a* and the left narrow wall 130*b*. Further, in the present embodiment, X11 (X12), X21 (X22)=200 μm is employed as the distance X11 (X12), X21 (X22). That is, each of the distances X11 (X12) and X21 (X22) is less than the post interval d.

As described above, according to the bandpass filter 1, both the distances X11 (X12) and X21 (X22) are each not more than 1.5 times the post interval d in the section $S_1$, which is the entire section of the waveguide region D1. It is therefore possible to prevent an electromagnetic wave which falls outside the passband from propagating along the outer edge of each of the upper wide wall 12*a* and the lower wide wall 12*b* from the input part 10*a* toward the output part 10*b*. Therefore, according to the bandpass filter 1, it is possible to realize a post-wall waveguide bandpass filter in which a bypass phenomenon is less likely to occur.

Furthermore, since, in the section $S_1$, both the distances X11 (X12) and X21 (X22) are each not more than the post interval d, it is possible to further prevent an electromagnetic wave which falls outside the passband. Therefore, according to the bandpass filter 1, it is possible to even more surely realize a post-wall waveguide bandpass filter in which a bypass phenomenon is less likely to occur.

Note that the bandpass filter 1 is configured such that, in the section $S_1$, all of the distance X11, the distance X12, the distance X21, and the distance X22 are each less than the post interval d. However, in the bandpass filter in accordance with an aspect of the present invention, it is not necessary that, in the section $S_1$, all of the distance X11, the distance X12, the distance X21, and the distance X22 be each less than the post interval d. The bandpass filter in accordance with an aspect of the present invention is only necessary to be configured such that, in the section $S_1$, at least any one of the distance X11, the distance X12, the distance X21, and the distance X22 is not more than 1.5 times the post interval d, more preferably not more than the post interval d.

(Variation)

Figure 4:
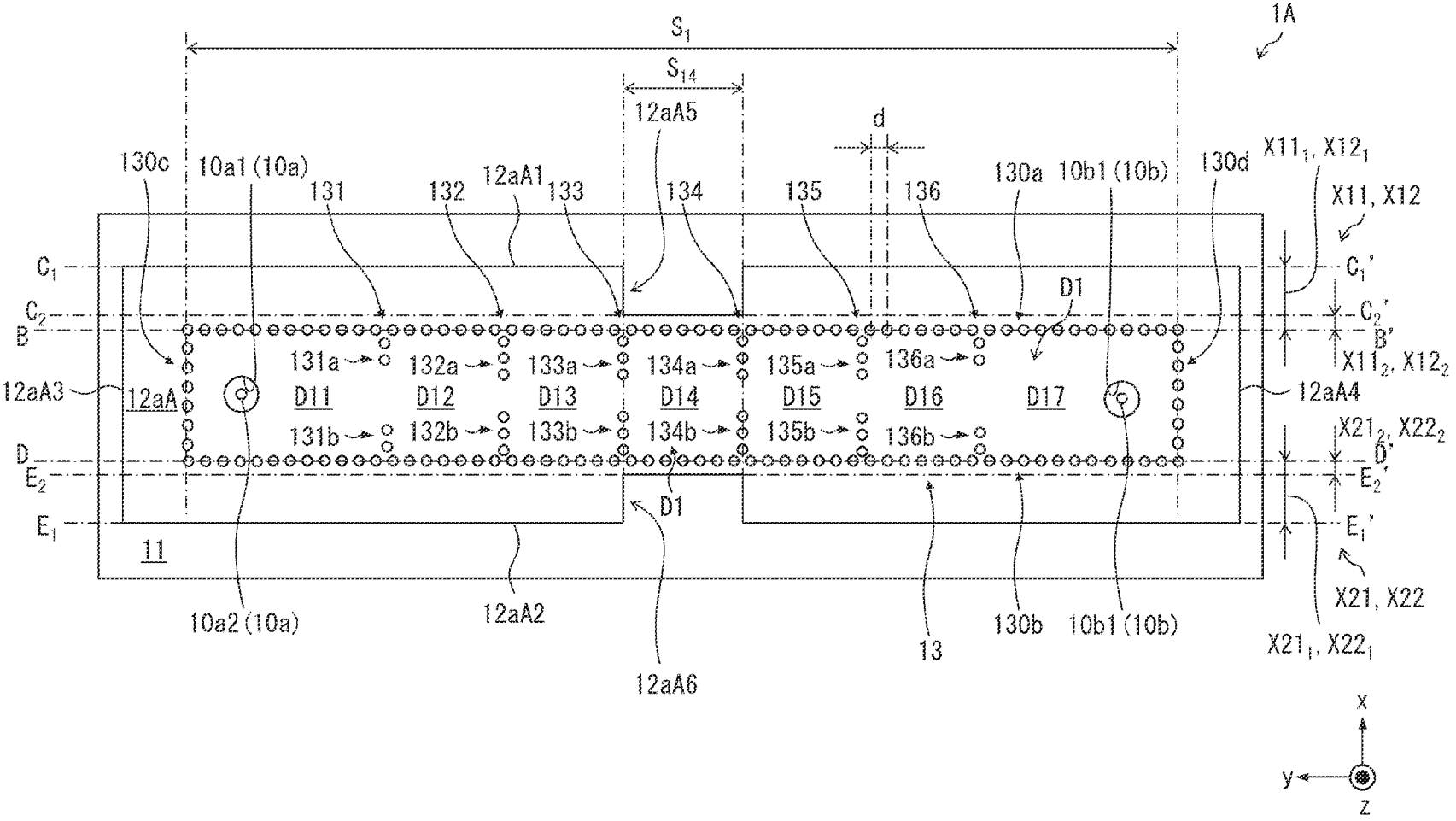
FIG. 4 is a plan view of a variation of the bandpass filter illustrated in FIG. 1.

According to the bandpass filter 1 in accordance with an embodiment of the present invention, in a case where each of the distances X11 (X12) and X21 (X22) is configured to be not more than 1.5 times the post interval d at least in a partial section of the waveguide region D1, it is possible to suppress a bypass phenomenon that can occur between the input part 10*a* and the output part 10*b*. A bandpass filter 1A obtained by making such an alteration to the bandpass filter 1 will be described with reference to FIG. 4. FIG. 4 is a plan view of the bandpass filter 1A, which is a variation of the bandpass filter 1.

As illustrated in FIG. 4, an upper wide wall 12*a*A included in the bandpass filter 1A is wider than the upper wide wall 12*a* included in the bandpass filter 1. In addition, in a section $S_{14}$ of the upper wide wall 12*a*A, a cutout 12*a*A5 is provided in an x-axis negative direction from a long side 12*a*A1, and a cutout 12*a*A6 is provided in an x-axis positive direction from a long side 12*a*A2. In the upper wide wall 12*a*A, distances X11 and X21 in part of a section $S_1$ which part is other than the section $S_{14}$ will be referred to as distances $X11_1$ and $X21_1$, respectively, and the distances X11 and X21 in the section $S_{14}$ will be referred to as distances $X11_2$ and $X21_2$, respectively. The section $S_{14}$ corresponds to a third resonance region D14 of a waveguide region D1. Therefore, the section $S_{14}$ is part of the section $S_1$.

According to the bandpass filter 1A, $X11_1$, $X21_1 > X11_2$, $X21_2$, and each of the distances $X11_2$ and $X21_2$ is not more than 1.5 times a post interval d. In the present variation, $X11_2$, $X21_2$=200 μm is employed as the distance $X11_2$, $X21_2$. That is, each of the distances $X11_2$ and $X21_2$ is not more than the post interval d. In this manner, also in the present variation, it is more preferable that each of the distances $X11_2$ and $X21_2$ be not more than the post interval d.

Note that, also in the present variation, the upper wide wall 12*a*A and a lower wide wall 12*b*A are congruous with each other, and are located so that their outer edges coincide with each other in a plan view. Thus, although the lower wide wall 12*b*A is not illustrated in FIG. 4, a distance X12 (distance $X12_1$, $X12_2$) and a distance X22 (distance $X22_1$, $X22_2$) are equal to the distance X11 (distance $X11_1$, $D11_2$) and the distance X21 (distance $X21_1$, $X21_2$), respectively.

As described above, according to the bandpass filter 1A, both $X11_2$ ($X12_2$) and $X21_2$ ($X22_2$) are each not more than 1.5 times the post interval d in the section $S_{14}$, which is part of the section $S_1$. It is therefore possible to prevent an electromagnetic wave which falls outside a passband. Therefore, according to the bandpass filter 1A, it is possible to realize a post-wall waveguide bandpass filter in which a bypass phenomenon is less likely to occur.

Furthermore, since, in the section $S_{14}$, both the distances $X11_2$ ($X12_2$) and $X21_2$ ($X22_2$) are each not more than the post interval d, it is possible to surely prevent an electromagnetic wave which falls outside the passband. Therefore, according to the bandpass filter 1A, it is possible to surely realize a post-wall waveguide bandpass filter in which a bypass phenomenon is less likely to occur.

Note that the bandpass filter 1A is configured such that, in the section $S_{14}$, all of the distance $X11_2$, the distance $X12_2$, the distance $X21_2$, and the distance $X22_2$ are each less than the post interval d. However, in the bandpass filter in accordance with an aspect of the present invention, it is not necessary that, in the section $S_{14}$, all of the distance $X11_2$, the distance $X12_2$, the distance $X21_2$, and the distance $X22_2$ be each less than the post interval d. The bandpass filter in accordance with an aspect of the present invention is only necessary to be configured such that, in the section $S_{14}$, at least any one of the distance $X11_2$, the distance $X12_2$, the distance $X21_2$, and the distance $X22_2$ is not more than 1.5 times the post interval d, more preferably not more than the post interval d.

EXAMPLES

Next, transmission characteristics were simulated with use of, as models, the configuration of the bandpass filter 1 illustrated in FIG. 2. In the following description, frequency dependence of a transmission coefficient (also referred to as S21) will be referred to as a transmission characteristic.

A model of the bandpass filter 1 which model employed X11=X12=X21=X22=200 μm as distances X11, X12, X21, and X22 was regarded as Example 1, and a model of the bandpass filter 1 which model employed X11=X12=X21=X22=300 μm was regarded as Example 2. In this Example group, d=200 μm was employed as a post interval d. Therefore, each of the distances X11, X12, X21, and X22 in Example 1 was not more than the post interval d, and each of the distances X11, X12, X21, and X22 in Example 2 was not more than 1.5 times the post interval d.

First, design parameters common to Examples 1 and 2 will be described. Each of Examples 1 and 2 was designed so that a low band (band of not less than 71 GHz and not more than 76 GHz) included in the E band served as a passband.

Each of Examples 1 and 2 employed, as a dielectric substrate 11, a quartz substrate having a thickness of 520 μm. Conductor films, each made of copper and having a thickness of 10 μm, were provided on respective two main surfaces of the dielectric substrate 11. The conductor films functioned as an upper wide wall 12*a* and a lower wide wall 12*b*, respectively.

In each of Examples 1 and 2, each of conductor posts in a right narrow wall 130*a*, a left narrow wall 130*b*, a front narrow wall 130*c*, a back narrow wall 130*d*, and six partition wall pairs, that is, first through sixth partition wall pairs 131 through 136, which constituted a post wall, was constituted by a copper conductor film provided on an inner wall of a through-hole via passing through the dielectric substrate 11. Each of the conductor posts had a diameter of 100 μm, and the post interval d was 200 μm. Note that, as has been described, the post interval d is a distance between respective centers of adjacent ones of the conductor posts (see, for example, FIG. 3).

In each of Examples 1 and 2, a polyimide resin having a thickness of 17.5 μm was employed as a dielectric layer 51 which constituted a first microstrip line 5 and as a dielectric layer 61 which constituted a second microstrip line 6.

Further, in each of Examples 1 and 2, an opening 10*a*1 which constituted an input part 10*a* had a circular shape having a diameter of 340 μm. A blind via 10*a*2 was constituted by a copper conductor film which was provided on an inner wall of a blind via provided in the dielectric substrate 11. Further, an opening 10*b*1 which constituted an output part 10*b* had a circular shape having a diameter of 340 μm. A blind via 10*b*2 was constituted by a copper conductor film which was provided on an inner wall of a blind via provided in the dielectric substrate 11.

Further, in each of Examples 1 and 2, a signal line 52 constituted by a copper strip-shaped thin film was provided on an upper surface of the dielectric layer 51. A land having a circular shape and having a diameter of 200 μm was provided at one of ends of the signal line 52 which one was in contact with the blind via 10*a*2. The land was provided inside the opening 10*a*1 and at a position overlapping the blind via 10*a*2 in a plan view. Further, a signal line 62 constituted by a copper strip-shaped thin film was provided on an upper surface of the dielectric layer 61. A land having a circular shape and having a diameter of 200 μm was provided at one of ends of the signal line 62 which one was in contact with the blind via 10*b*2. The land was provided inside the opening 10*b*1 and at a position overlapping the blind via 10*b*2 in a plan view.

Comparative Example

Figure 6:
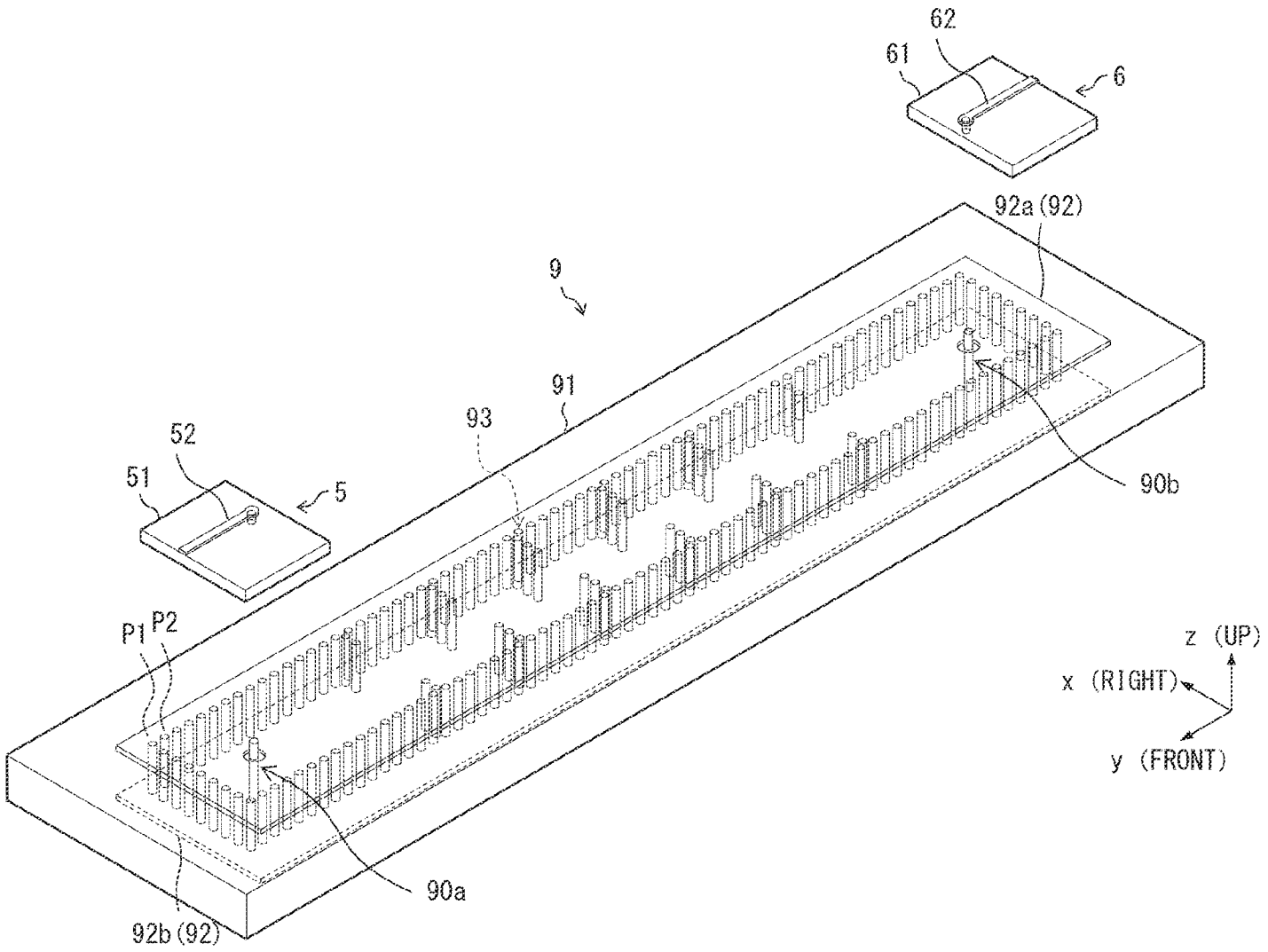
FIG. 6 PRIOR ART
FIG. 6 is an exploded perspective view of a conventional bandpass filter.
Figure 7:
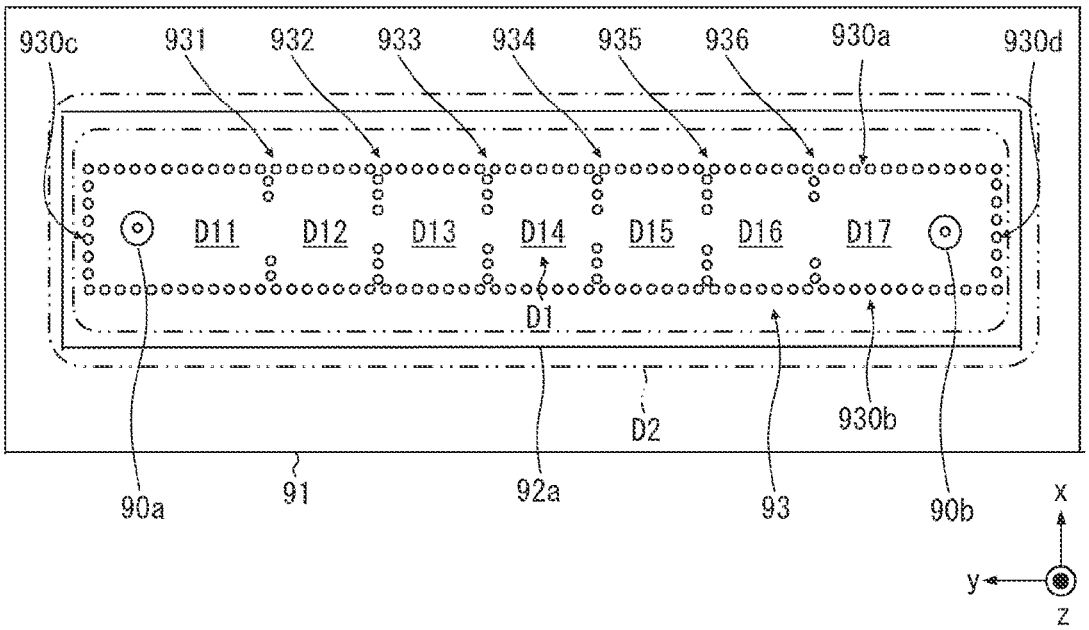
FIG. 7 PRIOR ART
FIG. 7 is a plan view of the bandpass filter illustrated in FIG. 6.

As a Comparative Example group for a comparison with the Example group, the configuration of the bandpass filter 9 illustrated in FIGS. 6 and 7, that is, a configuration in which a distance exceeding 1.5 times a post interval d was employed as each of distances X11, X12, X21, and X22 was used as a model for simulation. FIG. 6 is an exploded perspective view of the bandpass filter 9. FIG. 7 is a plan view of the bandpass filter 9.

In the Comparative Example group, design parameters identical to those of the foregoing bandpass filters 1 in the Example group were employed, except that the distance exceeding 1.5 times the post interval d was employed as each of the distances X11, X12, X21, and X22. A model which employed X11=X12=X21=X22=400 μm as the distances X11, X12, X21, and X22 was regarded as Comparative Example 1, a model which employed X11=X12=X21=X22=500 μm was regarded as Comparative Example 2, a model which employed X11=X12=X21=X22=600 μm was regarded as Comparative Example 3, and a model which employed X11=X12=X21=X22=800 μm was regarded as Comparative Example 4.

(Transmission Characteristics)

Figure 5:
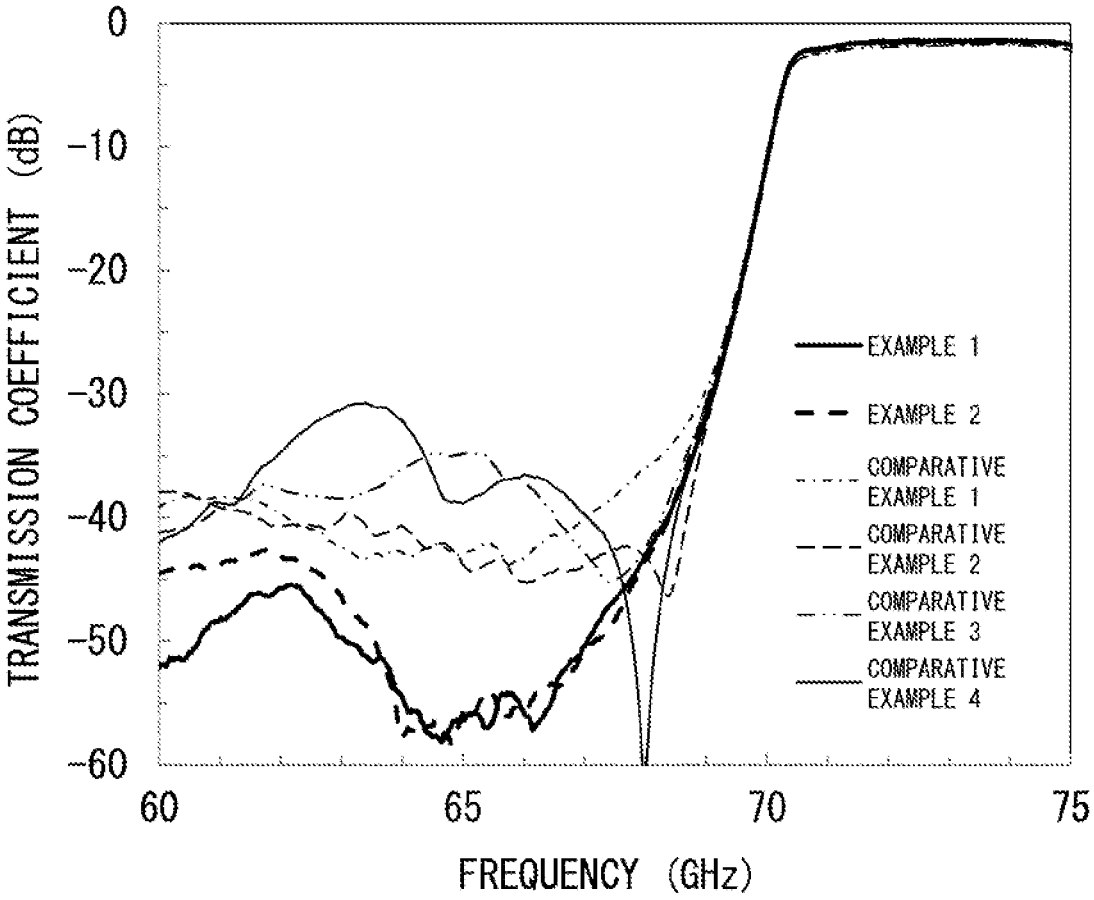
FIG. 5 is a graph showing transmission characteristics of an Example group of the present invention and a Comparative Example group.

As a result of varying each of the distances X11, X12, X21, and X22 as described above in a range of not less than 200 μm and not more than 800 μm, transmission characteristics shown in FIG. 5 were obtained for the bandpass filters 1 and bandpass filters 9. FIG. 5 is a graph showing transmission characteristics of the Example group and the Comparative Example group described above.

As shown in FIG. 5, it was found, in regard to the bandpass filters 9 of Comparative Examples 1 through 4, that transmission coefficients increased in a cutoff band (near 65 GHz) on a low-frequency side. It is considered that such increases in transmission coefficients were caused by a bypass phenomenon.

In contrast, it was found, in regard to the bandpass filters 1 of Examples 1 and 2, that increases in transmission coefficients in the cutoff band (near 65 GHz) on the low-frequency side were well suppressed. It is considered that the increases in the transmission coefficients were suppressed because a bypass phenomenon was suppressed by the fact that each of the distances X11, X12, X21, and X22 was not more than 1.5 times the post interval d.

Note that each of the bandpass filters 1 in the Example group was designed so that a low band (band of not less than 71 GHz and not more than 76 GHz) included in the E band served as a passband. Note, however, that each of these bandpass filters 1 is merely an example of the present invention, and the configuration of the present invention can be applied to bandpass filters each of which employs any other band as a passband. For example, the configuration of the present invention can be also applied to bandpass filters each of which employs, as a passband, a high band (not less than 81 GHz and not more than 86 GHz) included in the E band.

Aspects of the present invention can also be expressed as follows:

A bandpass filter (1,1A) in accordance with an aspect of the present invention is a bandpass filter (1,1A) including: a dielectric substrate (11); a first wide wall (upper wide wall 12*a*, 12*a*A) which is provided on a first main surface of the dielectric substrate (11); a second wide wall (lower wide wall 12*b*, 12*b*A) which is provided on a second main surface of the dielectric substrate (11); a post wall (13) which is provided inside the dielectric substrate (11) and which is constituted by a first short wall (front narrow wall 130*c*), a second short wall (back narrow wall 130*d*), a first side wall (right narrow wall 130*a*), and a second side wall (left narrow wall 130*b*); an input part (10*a*) which is provided near the first short wall (front narrow wall 130*c*) and via which an electromagnetic wave is inputted into a waveguide region (D1), the waveguide region (D1) being formed inside the dielectric substrate (11) by the first wide wall (upper wide wall 12*a*, 12*a*A), the second wide wall (lower wide wall 12*b*, 12*b*A), and the post wall (13) and including a plurality of resonance regions (D12 through D16); and an output part (10*b*) which is provided near the second short wall (back narrow wall 130*d*) and via which the electromagnetic wave is outputted from the waveguide region (D1), at least any one of first through fourth distances (X11, X21, X11$_2$, X21$_2$) being not more than 1.5 times a post interval (d) at least in a partial section ($S_1$, $S_{14}$) of the waveguide region (D1), the first distance (X11, X11$_2$) being a distance from a wall center of the first side wall (right narrow wall 130*a*) to part of an edge of the first wide wall (upper wide wall 12*a*, 12*a*A) which part extends along the first side wall (right narrow wall 130*a*), the second distance being a distance from the wall center of the first side wall (right narrow wall 130*a*) to part of an edge of the second wide wall (lower wide wall 12*b*, 12*b*A) which part extends along the first side wall (right narrow wall 130*a*), the third distance (X21, X21$_2$) being a distance from a wall center of the second side wall (left narrow wall 130*b*) to part of the edge of the first wide wall (upper wide wall 12*a*, 12*a*A) which part extends along the second side wall (left narrow wall 130*b*), the fourth distance being a distance from the wall center of the second side wall (left narrow wall 130*b*) to part of the edge of the second wide wall (lower wide wall 12*b*, 12*b*A) which part extends along the second side wall (left narrow wall 130*b*), the post interval (d) being a distance between respective centers of adjacent ones of a plurality of conductor posts (P1 through Pi) which constitute the first side wall (right narrow wall 130*a*) and the second side wall (left narrow wall 130*b*).

Each of the first short wall (front narrow wall 130*c*), the second short wall (back narrow wall 130*d*), the first side wall (right narrow wall 130*a*), and the second side wall (left narrow wall 130*b*) is constituted by a subset of the plurality of conductor posts (P1 through Pi). The first distance (X11, X11$_2$) is, in other words, the shortest distance out of a distance from the wall center of the first side wall (right narrow wall 130*a*) to part of the edge of the first wide wall (upper wide wall 12*a*, 12*a*A) which part is substantially parallel to the wall center of the first side wall (right narrow wall 130*a*). The second distance is, in other words, the shortest distance out of a distance from the wall center of the first side wall (right narrow wall 130*a*) to part of the edge of the second wide wall (lower wide wall 12*b*, 12*b*A) which part is substantially parallel to the wall center of the first side wall (right narrow wall 130*a*). The third distance (X21, X21$_2$) is, in other words, the shortest distance out of a distance from the wall center of the second side wall (left narrow wall 130*b*) to part of the edge of the first wide wall (upper wide wall 12*a*, 12*a*A) which part is substantially parallel to the wall center of the second side wall (left narrow wall 130*b*). The fourth distance is, in other words, the shortest distance out of a distance from the wall center of the second side wall (left narrow wall 130*b*) to part of the edge of the second wide wall (lower wide wall 12*b*, 12*b*A) which part is substantially parallel to the wall center of the second side wall (left narrow wall 130*b*).

According to the above configuration, since at least any one of the first through fourth distances is not more than 1.5 times the post interval at least in the partial section of the waveguide region, it is possible to prevent an electromagnetic wave which falls outside a passband from propagating along at least any one of the edge of the first wide wall and the edge of the second wide wall from the input part toward the output part. Therefore, according to the bandpass filter, it is possible to realize a post-wall waveguide bandpass filter in which a bypass phenomenon is less likely to occur.

The bandpass filter (1) in accordance with an aspect of the present invention is preferably arranged such that the at least any one of the first through fourth distances (X11, X21) is not more than 1.5 times the post interval (d) in an entire section ($S_1$) of the waveguide region (D1).

According to the above configuration, it is possible to surely prevent the electromagnetic wave which falls outside the passband, as compared with a case where the at least any one of the first through fourth distances is not more than 1.5 times the post interval at least in the partial section of the waveguide region. Therefore, according to the bandpass filter, it is possible to surely realize a post-wall waveguide bandpass filter in which a bypass phenomenon is less likely to occur.

The bandpass filter (1, 1A) in accordance with an aspect of the present invention is preferably arranged such that the at least any one of the first through fourth distances (X11, X21, X11$_2$, X21$_2$) is not more than the post interval (d) at least in the partial section ($S_1$, $S_{14}$) of the waveguide region (D1).

According to the above configuration, it is possible to more surely prevent the electromagnetic wave which falls outside the passband, as compared with the case where the at least any one of the first through fourth distances is not more than 1.5 times the post interval at least in the partial section of the waveguide region. Therefore, according to the bandpass filter, it is possible to more surely realize a post-wall waveguide bandpass filter in which a bypass phenomenon is less likely to occur.

The bandpass filter (1) in accordance with an aspect of the present invention is preferably arranged such that the at least any one (X11, X21) of the first through fourth distances is not more than the post interval (d) in an entire section ($S_1$) of the waveguide region (D1).

According to the above configuration, it is possible to even more surely prevent the electromagnetic wave which falls outside the passband, as compared with the bandpass filters in accordance with the above aspects. Therefore, according to the bandpass filter, it is possible to even more surely realize a post-wall waveguide bandpass filter in which a bypass phenomenon is less likely to occur.

The present invention is not limited to the embodiments, but can be altered by a skilled person in the art within the scope of the claims. The present invention also encompasses, in its technical scope, any embodiment derived by combining technical means disclosed in differing embodiments.

REFERENCE SIGNS LIST

1, 1A Bandpass filter
11 Dielectric substrate
12*a*, 12*a*A Upper wide wall
12*a*1, 12*a*2, 12*b*1, 12*b*2, 12*a*A1, 12*a*A2 Long side
12*b* Lower wide wall
13 Post wall
130*a* Right narrow wall (first side wall)
130*b* Left narrow wall (second side wall)
130*c* Front narrow wall (first short wall)
130*d* Back narrow wall (second short wall)

The invention claimed is:

1. A bandpass filter comprising:

a dielectric substrate;

a first wide wall which is provided on a first main surface of the dielectric substrate;

a second wide wall which is provided on a second main surface of the dielectric substrate;

a post wall which is provided inside the dielectric substrate and which is constituted by a first short wall, a second short wall, a first side wall, and a second side wall;

an input part which is provided near the first short wall and via which an electromagnetic wave is inputted into a waveguide region, the waveguide region being formed inside the dielectric substrate by the first wide wall, the second wide wall, and the post wall and including a plurality of resonance regions; and an output part which is provided near the second short wall and via which the electromagnetic wave is outputted from the waveguide region, at least any one of first through fourth distances being not more than 1.5 times a post interval at least in a partial section of the waveguide region, the first distance being a distance from a wall center of the first side wall to part of an edge of the first wide wall which part extends along the first side wall, the second distance being a distance from the wall center of the first side wall to part of an edge of the second wide wall which part extends along the first side wall, the third distance being a distance from a wall center of the second side wall to part of the edge of the first wide wall which part extends along the second side wall, the fourth distance being a distance from the wall center of the second side wall to part of the edge of the second wide wall which part extends along the second side wall, the post interval being a distance between respective centers of adjacent ones of a plurality of conductor posts which constitute the first side wall and the second side wall.

2. The bandpass filter as set forth in claim 1, wherein the at least any one of the first through fourth distances is not more than 1.5 times the post interval in an entire section of the waveguide region.

3. The bandpass filter as set forth in claim 1, wherein the at least any one of the first through fourth distances is not more than the post interval at least in the partial section of the waveguide region.

4. The bandpass filter as set forth in claim 1, wherein the at least any one of the first through fourth distances is not more than the post interval in an entire section of the waveguide region.

* * * * *